US005248996A

United States Patent [19]

Kato et al.

[11] Patent Number: 5,248,996

[45] Date of Patent: Sep. 28, 1993

[54] THERMAL TRANSFER RECORDING APPARATUS WHICH AVOIDS INK SHEET STICKING AFTER RECORDING DATA RECEPTION IS INTERRUPTED

[75] Inventors: Takahiro Kato, Yokohama; Takehiro Yoshida, Tokyo; Takeshi Ono, Yokohama; Satoshi Wada, Kawasaki; Tomoyuki Takeda, Yokohama; Masaya Kondo, Tokyo; Makoto Kobayashi, Tama; Minoru Yokoyama; Akihiro Tomoda, both of Yokohama; Yasushi Ishida, Tokyo; Takashi Awai; Masakatsu Yamada, both of Yokohama, all of Japan

[73] Assignee: Canon Kabushiki Kaisha, Tokyo, Japan

[21] Appl. No.: 918,120

[22] Filed: Jul. 22, 1992

Related U.S. Application Data

[63] Continuation of Ser. No. 646,223, Jan. 28, 1991, abandoned.

[30] Foreign Application Priority Data

Feb. 1, 1990 [JP] Japan ..... 2-20401

[51] Int. Cl.[5] ..... B41J 2/235; B41J 2/38

[52] U.S. Cl. ..... 346/76 PH; 346/134; 346/136; 358/296

[58] Field of Search ..... 346/76 PH, 134, 136; 358/296

[56] References Cited

U.S. PATENT DOCUMENTS

| | | | |
|---|---|---|---|
| 4,456,392 | 6/1984 | Nozaki et al. | 400/120 |
| 4,531,133 | 7/1985 | Leng | 346/76 PH |
| 4,568,817 | 2/1986 | Leng et al. | 346/76 PH |
| 4,677,660 | 6/1987 | Yoshida | 379/100 |
| 4,717,967 | 1/1988 | Yoshida | 358/296 |
| 4,875,056 | 10/1989 | Ono | 346/76 PH |
| 4,963,884 | 10/1990 | Kiguchi et al. | 346/1.1 |

FOREIGN PATENT DOCUMENTS

| | | | |
|---|---|---|---|
| 0295953 | 12/1988 | European Pat. Off. . | |
| 57-83471 | 5/1982 | Japan . | |
| 62-58917 | 1/1983 | Japan . | |
| 58-201686 | 11/1983 | Japan . | |
| 59-184679 | 10/1984 | Japan . | |
| 61-197256 | 9/1986 | Japan . | |
| 0003969 | 1/1987 | Japan | 346/76 PH |
| 0094360 | 4/1987 | Japan | 346/76 PH |
| 0251160 | 10/1987 | Japan | 400/120 |

OTHER PUBLICATIONS

Eur. Pat. Off. Search Report for Eur. Pat. App. No. 91101405.0.

*Primary Examiner*—Joseph W. Hartary
*Assistant Examiner*—Huan Tran
*Attorney, Agent, or Firm*—Fitzpatrick, Cella, Harper & Scinto

[57] ABSTRACT

There is disclosed a thermal transfer printer utilizing a one time ink sheet or a multi-print ink sheet. In order to avoid sticking of the ink sheet and the recording sheet, for example where there is an interruption in facsimile transmission or when a recording interval exceeds a predetermined time, the thermal head is energized to maintain a high temperature state and then the recording paper is transported by a predetermined amount, thereby separating the ink sheet and the recording paper.

6 Claims, 8 Drawing Sheets

THERMAL TRANSFER RECORDING APPARATUS WHICH AVOIDS INK SHEET STICKING AFTER RECORDING DATA RECEPTION IS INTERRUPTED

This application is a continuation of application Ser. No. 07/646,223 filed Jan. 28, 1991, now abandoned.

BACKGROUND OF THE INVENTION

1. Field of the Invention

The present invention relates to a thermal transfer recording apparatus for image recording on a recording medium by transfer of ink from an ink sheet, and a facsimile apparatus utilizing such a recording apparatus.

2. Related Background Art

In general thermal transfer printers utilize an ink sheet consisting of a substrate film coated with heat-fusible (or heat sublimable) ink, and effect image recording by selectively heating said ink sheet with a thermal head according to an image signal, thereby transferring thus fused (or sublimed) ink onto a recording sheet. Since the ink sheet is generally a so-called one-time ink sheet in which the ink is completely transferred to the recording sheet by a single image recording, it is necessary, after the image recording of a character or a line, to advance the ink sheet by a distance corresponding to the recorded length, thereby securely bringing an unused portion of the ink sheet to the next recording position. Consequently the amount of the ink sheet used increases, and such thermal transfer printers tend to have high running costs in comparison with ordinary thermal printers utilizing thermosensitive recording paper.

In order to prevent this drawback, there have already been proposed thermal transfer printers in which the recording sheet and the ink sheet are transported with different speeds, as disclosed in Japanese Patent Appln. Laid-Open Nos. 57-83471 and No. 58-201686 and in the Japanese Patent Publication No. 62-58917.

Also used in such thermal transfer printers, there is already known a multi-print ink sheet capable of plural (n) image recordings. In continuous image recording of a length L, such an ink sheet allows a reduction in the length thereof, transported during or after image recording, to a value smaller than L (said value being L/n; $n>1$). The efficiency of use of the ink sheet can therefore be increased to n times the conventional efficiency, and a reduction in the running cost of the thermal transfer printer can be expected. Such a recording method will hereinafter be called the multi printing method.

In such a multi printing, the ink constituting the ink layer of the ink sheet is heated n times, and ink transfer to the recording sheet is achieved by generating a shearing force between an ink layer portion fused in each heating and an unfused ink layer portion. In such a printing method, if the recording of a line does not take place immediately after the recording of a preceding line, the temperature of the ink layer is lowered, and the shearing strength between the fused ink layer portion transferred to the recording sheet and the unfused ink layer portion increases so that it becomes more difficult to separate the ink sheet from the recording sheet. This phenomenon becomes more conspicuous when the recording data of a line contains a large number of black data.

SUMMARY OF THE INVENTION

In consideration of the foregoing, an object of the present invention is to provide an improved thermal transfer recording apparatus and a facsimile apparatus utilizing the recording apparatus.

Another object of the present invention is to provide a thermal transfer recording apparatus capable of preventing damage or sticking of the ink sheet, and a facsimile apparatus utilizing the recording apparatus.

Still another object of the present invention is to provide a thermal transfer recording apparatus with improved separability of the ink sheet and the recording medium, and a facsimile apparatus utilizing the recording apparatus.

Still another object of the present invention is to provide a thermal transfer recording apparatus capable of preventing damage or sticking of the ink sheet, in which, for example at an interruption in the recording operation, the ink sheet and the recording medium are separated by heating the ink sheet and then transporting the recording medium by a predetermined amount.

The foregoing and still other objects of the present invention will become fully apparent from the following description which is to be taken in conjunction with the attached drawings.

DESCRIPTION OF THE PREFERRED EMBODIMENTS

Now the present invention will be clarified in detail by preferred embodiments thereof, with reference to the attached drawings.

FACSIMILE APPARATUS (FIGS 1 TO 4)

Figure 1:
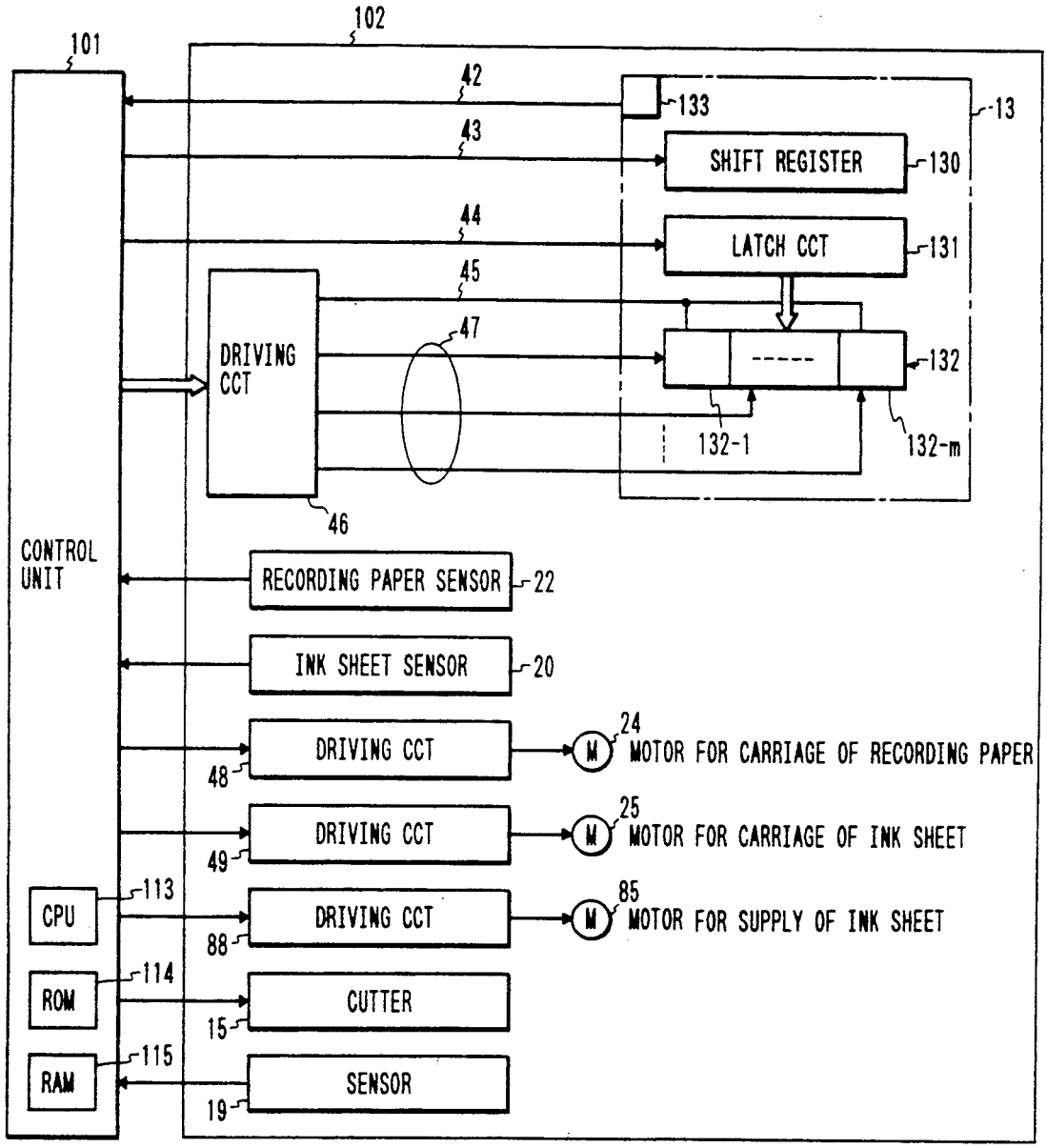
FIG. 1 is a block diagram showing electric connections between a control unit and a recording unit in a facsimile apparatus constituting an embodiment of the present invention.
Figure 2:
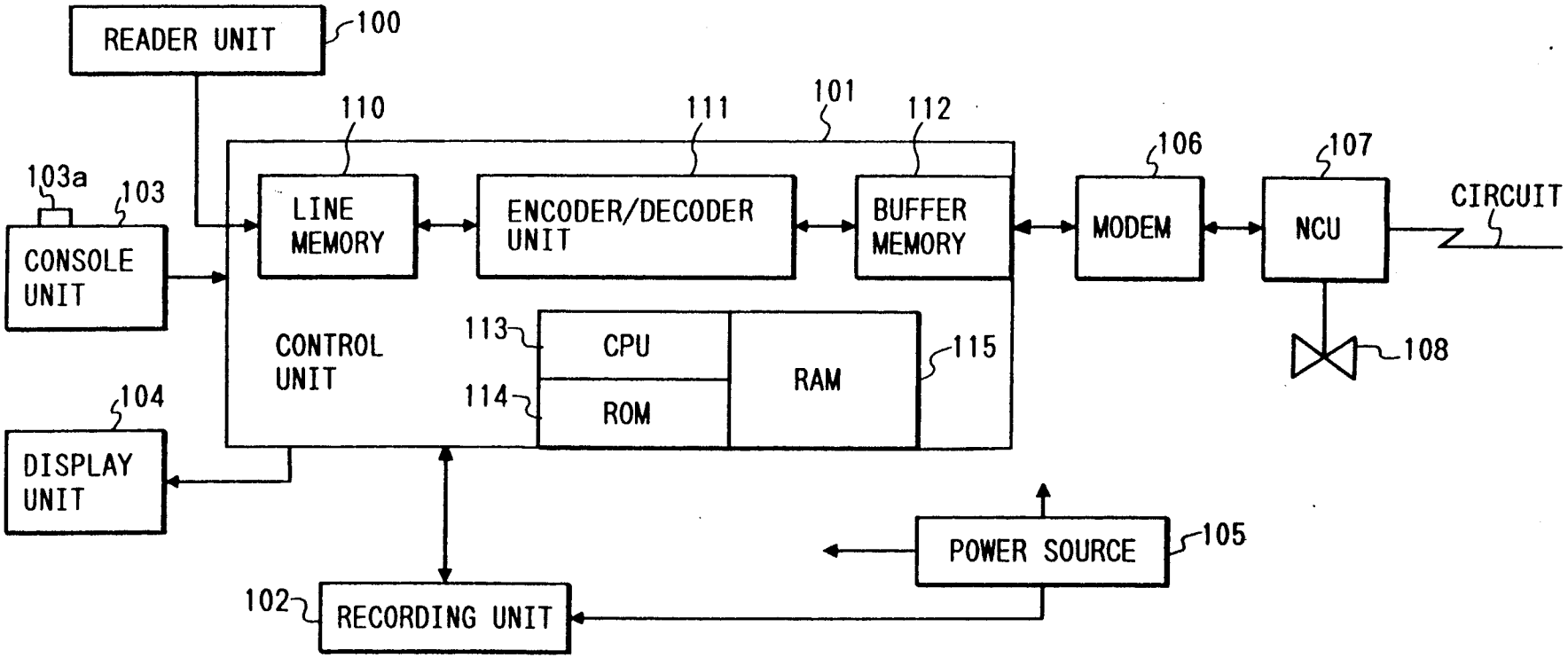
FIG. 2 is a block diagram showing schematic structure of the facsimile apparatus of the embodiment.
Figure 3:
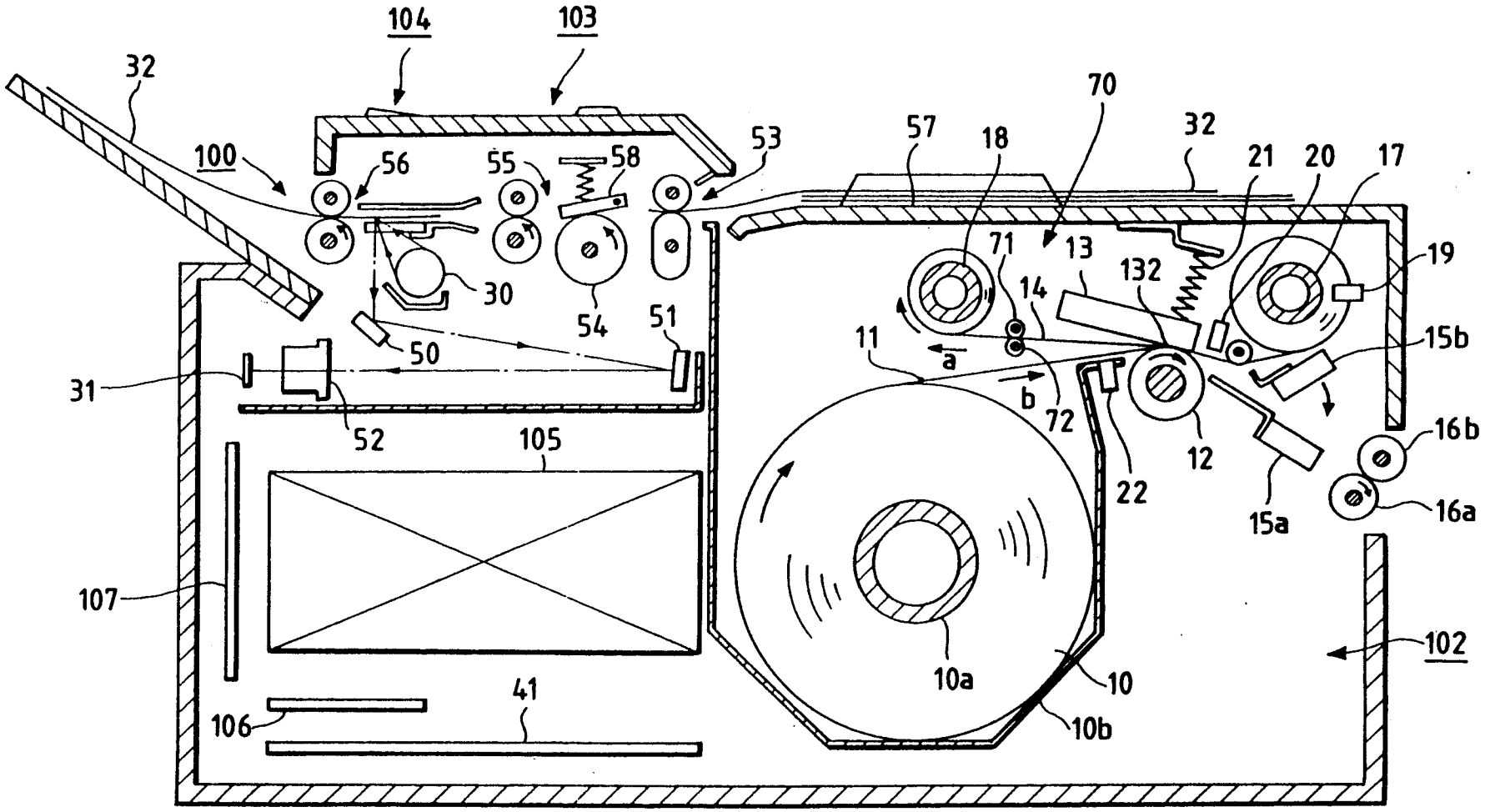
FIG. 3 is a lateral cross-sectional view of the mechanism of the facsimile apparatus.
Figure 4:
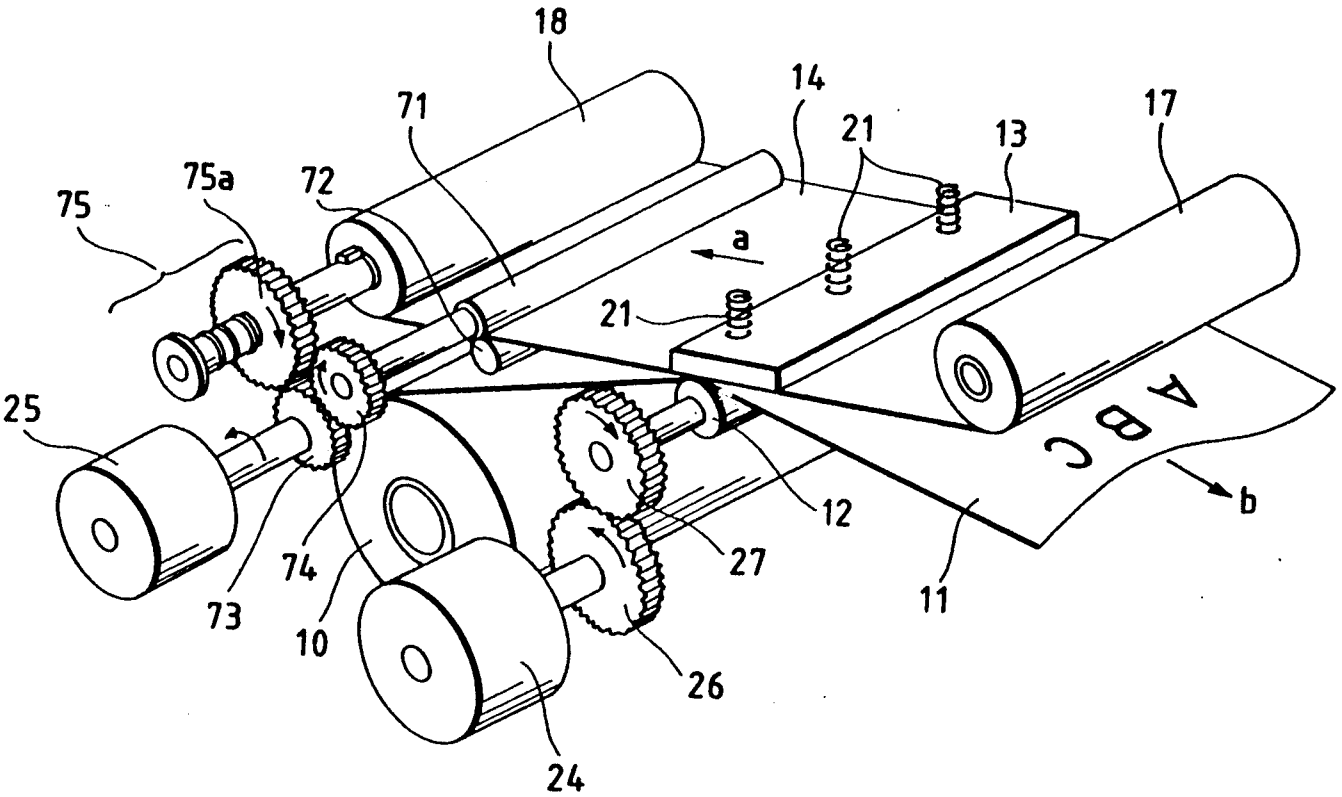
FIG. 4 is a perspective view of a transport mechanism for the recording sheet and the ink sheet of the embodiment.

FIGS. 1 to 4 show a thermal transfer recording apparatus embodying the present invention and applied to a facsimile apparatus, wherein FIG. 1 is a block diagram showing electrical connections between a control unit 101 and a recording unit 102 of the facsimile apparatus; FIG. 2 is a block diagram of the schematic structure of the facsimile apparatus; FIG. 3 is a lateral cross-sectional view of the facsimile apparatus; and FIG. 4 is a perspective view of a transport mechanism for a recording sheet 1 and an ink sheet 14 in the recording unit 102.

At first reference is made to FIG. 2 for explaining the schematic structure of the facsimile apparatus constituting an embodiment of the present invention.

A reader unit 100 for photoelectrically reading an original image and sending a digital image signal to a control unit 101, is provided with an original transporting motor and a CCD image sensor. The control unit 101 is constructed in the following manner. A line memory 110, for storing image data of each line, serves to store the image data of a line from the reader unit 100 in case of the original transmitting or copying mode, or the received and decoded image data of a line in case of the image data receiving mode. The image formation is conducted by transferring thus stored data to the recording unit 102. An encoder/decoder unit 111 encodes the image information to be transmitted, for example by MH encoding, and decodes the received encoded data into image data. A buffer memory 112 stores image data which are to be transmitted or which have been received. These units of the control unit 101 are controlled by a CPU 113 composed for example of a microprocessor. The control unit 101 is further provided with a ROM 114 storing control programs of the CPU 113 and other various data, and a RAM 115 functioning as a work area for the CPU 113 and serves to temporarily store various data.

A recording unit 102 is provided with a thermal line head and serves to record an image on the recording sheet using the thermal transfer recording method. The details of the recording unit will be explained later with reference to FIG. 3. An operation console unit 103 is provided with various functional keys, for example for starting the transmission, and telephone number input keys. A key 103*a* thereof, provided for instructing the kind of the ink sheet used, indicates a multi-printing ink sheet or an ordinary ink sheet respectively when the switch 103*a* is on or off. There are also provided a display unit 104, usually positioned next to the operation console unit and used for displaying the state of various functions or of the apparatus; a power source unit 105 for supplying the entire apparatus with electric power; a modem (modulator/demodulator) 106; a network control unit (NCU) 107 for effecting an automatic call receiving operation by detecting the call tone and a line controlling operation; and a telephone unit 108.

In the following there will be given a detailed explanation on the structure of the recording unit 102 with reference to FIG. 3, in which the same components as those in the preceding drawings are represented by the same numbers.

Referring to FIG. 3, a sheet roll 10, composed of plain recording paper 11 wound on a core 10*a*, is rotatably supported in the apparatus so as to feed the recording sheet 11 to a thermal head 13 by the rotation of a platen roller 12 in a direction indicated by an arrow. A sheet roll holding unit 10*b* removably holds the sheet roll 10. The platen roller 12 serves to transport the recording sheet 11 in a direction b, and to press an ink sheet 14 and the recording sheet 11 toward heat-generating resistors 132 of the thermal head 13. The recording sheet 11, which has been subjected to image recording by the heat generation of the thermal head 13, is transported toward discharge rollers 16 (16*a*, 16*b*) by further rotation of the platen roller 12, and, upon completion of image recording of a page, is cut into a page-sized sheet by mutual engagement of cutter members 15 (15*a*, 15*b*).

An ink sheet supply roller 17 on which the ink sheet 14 is wound, and an ink sheet take-up roller 18 are driven by an ink sheet transport motor to be explained later, thereby transporting the ink sheet 14 in a direction a. The ink sheet supply roller 17 and ink sheet take-up roller 18 are detachably loaded in an ink sheet loading unit 70 in the main body of the apparatus. There are also provided a sensor 19 for detecting the remaining amount and the transport speed of the ink sheet 14; an ink sheet sensor 20 for detecting the presence or absence of the ink sheet 14 a spring 21 for pressing the thermal head 13 against the platen roller 12 across the recording sheet 11 and the ink sheet 14; and a recording sheet sensor 22 for detecting the presence or absence of the recording sheet.

In the following the structure of the reader unit 100 is explained.

A light source 30 illuminates an original 32. The light reflected by the original 32 passes through an optical system (mirrors 50, 51 and a lens 52), enters a CCD sensor 31 and converted into electrical signals therein. The original 32 is transported with a speed corresponding to the reading speed of said original 32, by transport rollers 53, 54, 55, 56 driven by a transport motor (not shown). An original stacker table 57 supports plural originals 32 which are individually separated and advanced to the reader unit 100, through the cooperation of a transport roller 54 and a separating member 58.

A control circuit board 41, constituting the principal part of the control unit 101, sends various control signals to various parts of the apparatus. There are also provided a power source unit 105 for supplying electric power to the various parts of the apparatus; a modem board unit 106; and a NCU board unit 107 for making connection with the external telephone lines.

FIG. 4 shows the details of the transport mechanism for the ink sheet 14 and the recording sheet 11.

In FIG. 4 there are shown a recording sheet transport motor 24 for rotating the platen roller 12 thereby transporting the recording sheet 11 in a direction b opposite to the direction a; an ink sheet transport motor 25 for transporting the ink sheet 14 in the direction a by means of a capstan roller 71 and a pinch roller 72; gears 26, 27 for transmitting the rotation of the recording sheet transport motor 24 to the platen roller 12; gears 73, 74 for transmitting the rotation of the ink sheet transport motor 25 to the capstan roller 71; and a slip clutch unit 75.

The ink sheet 14 advanced by the capstan roller 71 can be securely wound on the take-up roller 18 by selecting the ratio of the gears 74, 73 so that the length of the ink sheet 14 wound on the take-up roller 18 by the rotation of the gear 75*a* is larger than that transported by the capstan roller 71. The difference between the length of the ink sheet 14 wound by the take-up roller 18 and that advanced by the capstan roller 71 is absorbed by the slip clutch unit 75. It is thus possible to prevent fluctuation in the transport speed (or length) of the ink sheet 14, resulting from changes in the winding diameter of the take-up roller 18.

FIG. 1 shows the electric connections of the control unit 101 and the recording unit 102 of the facsimile apparatus of the present embodiment, wherein components shown in other drawings are represented by the same numbers.

The thermal head 13, constructed as a line head, is provided with a shift register 130 for receiving serial recording data or shift clock signals 3 of a line from the control unit 101, a latch circuit 131 for latching the data of the shift register 130 by a latch signal 44; and heat-generating resistors 132 of a line, which are divided into m blocks for driving, as illustrated by 132-1-132-m.

A temperature sensor 133 is mounted on the thermal head 13 for detecting the temperature thereof. An output signal 42 of the sensor 133 is A/D converted in the control unit 101 and supplied to the CPU 113, which thus detects the temperature of the thermal head 13 and regulates the energy supplied thereto according to the characteristics of the ink sheet 14, for example by varying the pulse duration of a strobe signal 47 or the driving voltage of the thermal head 13. A programmable timer 116 is set for the measurement of a time by the CPU 113, starts time measurement upon receiving a command therefor, and sends an interruption signal or a time-out signal to the CPU 113 after the lapse of each designated time.

The characteristic or kind of the ink sheet 14 may be identified by the state of the switch 103*a* of the operation console unit 103 explained before, or by a mark printed on said ink sheet 14, or by a mark, a notch or a projection provided on the cartridge of the ink sheet.

A drive circuit 46 receives drive signals for the thermal head 13 from the control unit 101, and releases strobe signals 47 for driving each block of the thermal head 13. The drive circuit 46 is capable, in response to an instruction from the control unit 101, of varying the voltage supplied to a power supply line 45 for driving the heat-generating resistors 132 of the thermal head 13, thereby varying the energy supplied thereto. A drive circuit 36 for the cutter members 15 includes a cutter driving motor. A sheet discharge motor 39 drives the sheet discharge rollers 16. Drive circuits 35, 48, 49 are provided for respectively driving the sheet discharge motor 39, recording sheet transport motor 24 and ink sheet transport motor 25. These motors are composed of stepping motors in the present embodiment, but other types of motors such as DC motors may be employed for this purpose.

RECORDING PROCESS (FIGS. 1-5)

Figure 5:
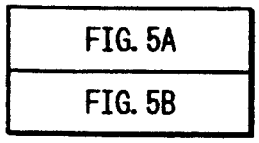
FIG. 5 consisting of FIGS. 5A and 5B is a flow chart of the recording sequence in the facsimile apparatus of the embodiment.
Figure 5A:
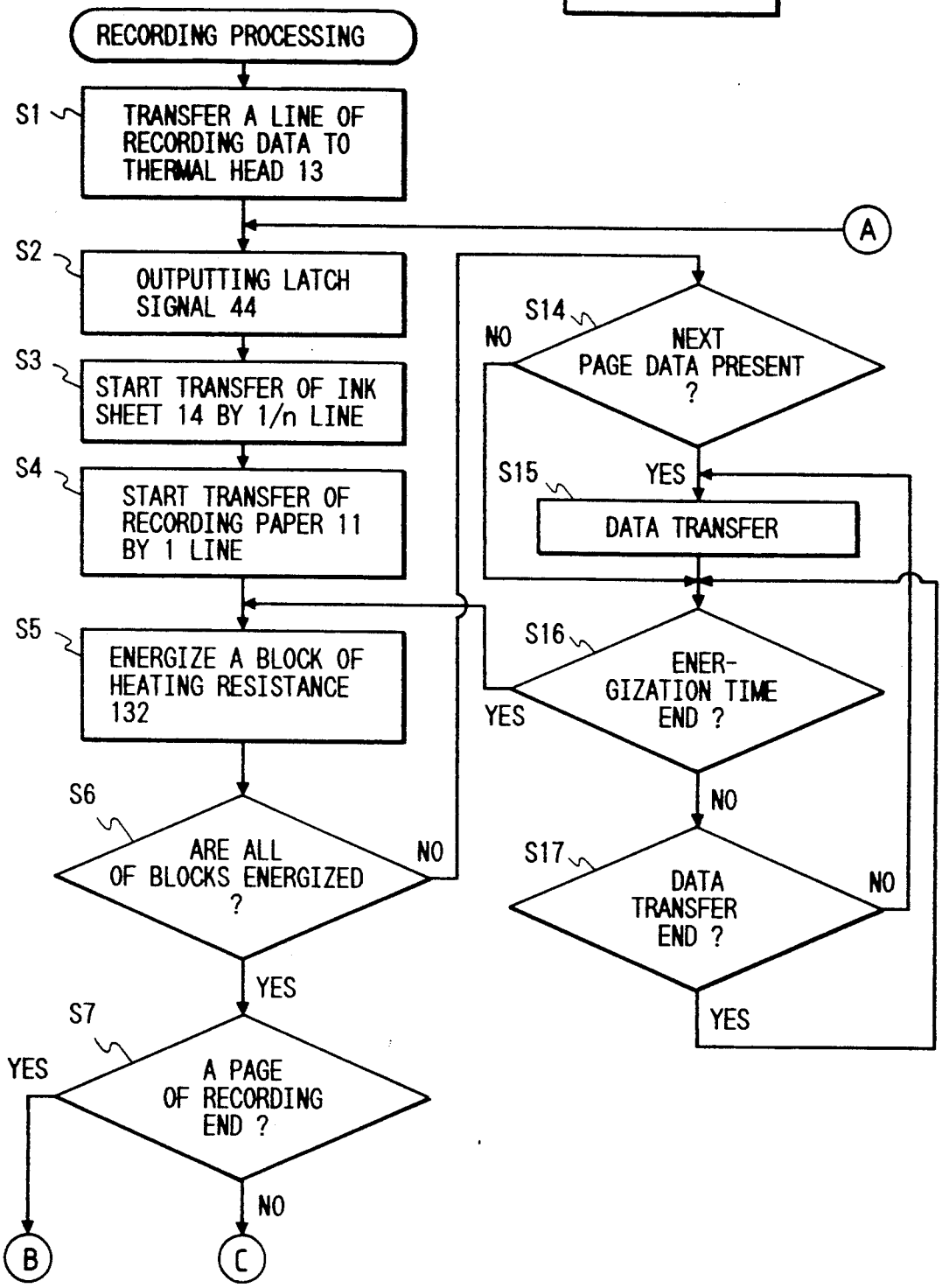
Figure 5B:
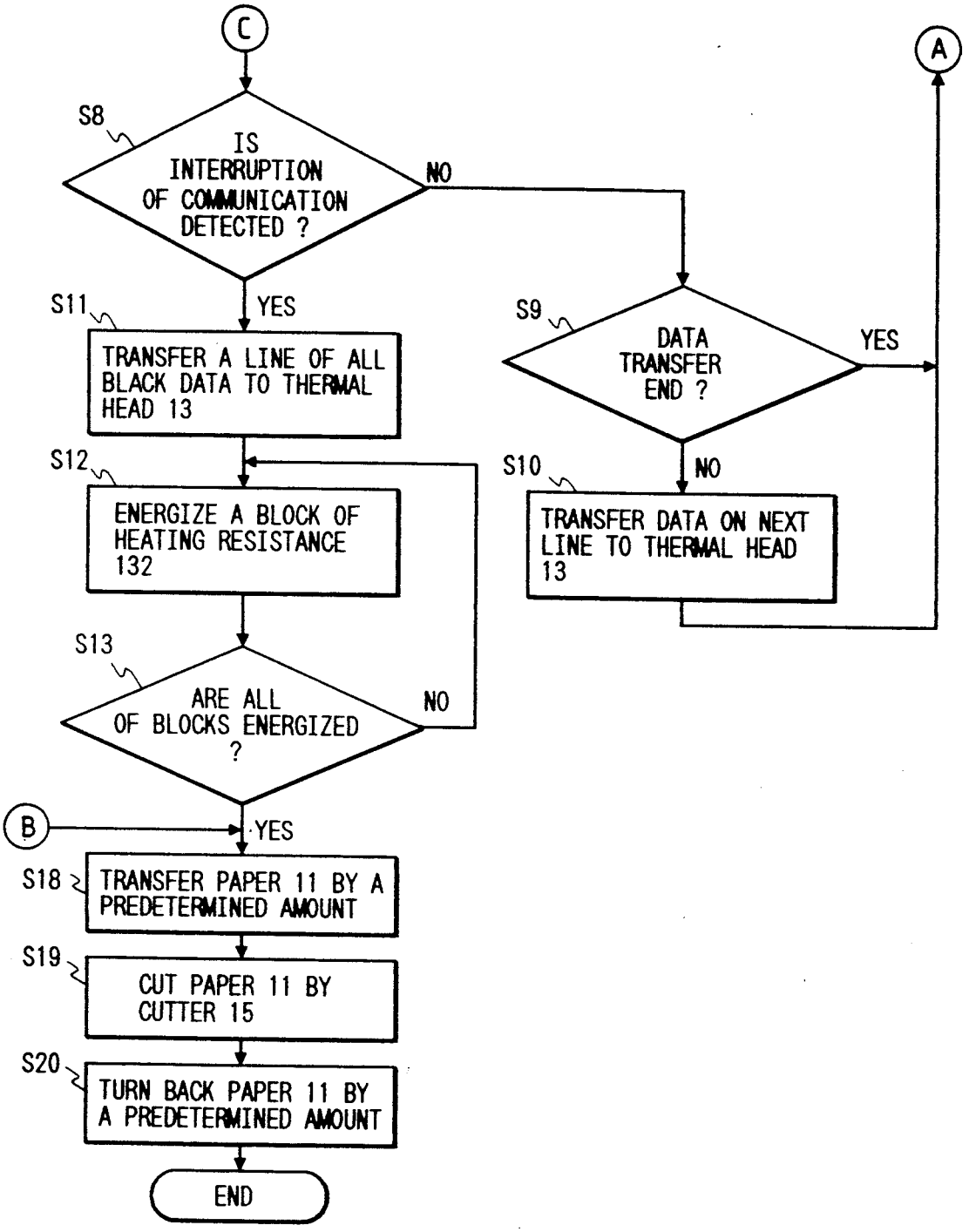

FIG. 5 is a flow chart of a recording sequence in the facsimile apparatus of the present embodiment, and a corresponding control program is stored in the ROM 114 of the control unit 101. This sequence is activated when facsimile data are received and decoded and image data of a line are stored in the line memory 110. It is assumed that the control unit 101 detects the loading of a multipoint ink sheet for example through the switch 103*a*.

At first a step S1 transfers the recording data of a line to the shift register 130 of the thermal head 13, and a step S2 releases a latch signal 44 to store the recording data of a line in the latch circuit 131. Then a step S3 starts the transportation of the ink sheet 14 by some fraction 1/n of a line pitch, and a step S4 starts the transportation of the recording sheet by a line pitch (1/15.4 mm).

Then a step S5 energizes one of the blocks of the heat generating resistors 132 of the thermal head 13, and a step S6 discriminates whether all the blocks of the heat generating resistors 312 have been energized. If not, the sequence proceeds to a step S14, and steps S14–S17 transfer the recording data of a next line to the shift register 130 of the thermal head 13. When the step S16 identifies completion of energizing time (600 μs) for a block, the sequence returns to the step S5 for effecting the energization of a next block. In the present embodiment, the thermal head 13 is driven in four blocks (m=4), so that the time required for the recording of a line is about 2.5 ms (600 μs per block×4 blocks).

When the step S6 identifies the completion of energization of all the four blocks, or the completion of recording of a line, a step S7 discriminates whether the recording of a page has been completed. After recording of a page, a step S18 advances the recording sheet 11 by a predetermined amount toward the discharge rollers 16 (16*a*, 16*b*), and a step S19 drives the cutter members 15 (15*a*, 15*b*) thereby cutting the recording sheet 11 into a page length. The cut sheet 11 is discharged by the rollers 16 from the apparatus, and a step S20 reverses the remaining recording sheet 11 by an amount corresponding to the distance between the thermal head 13 and the cutter members 15 (predetermined amount−$\alpha$).

On the other hand, if the step S7 identifies that the recording of a page has not been completed, a step S8 discriminates whether the communication has been interrupted. If not, a step S9 discriminates whether the data of a next line are present and have been transferred to the thermal head 13. The sequence returns to the step S2 if the data have been transferred. If the transfer has not been completed, a step S10 transfers the data of the next line to the thermal head 13 and the sequence returns to the step S2.

On the other hand, if the step S8 identifies an interrupted communication, the sequence proceeds to a step S11 for transferring all-black line data to the thermal head 13. Then steps S12 and S13 energize the heat generating resistor 132 by the blocks thereof, thereby heating the resistors in order to prevent a temperature decrease in the ink layer of the ink sheet 14. While the ink layer is maintained at a high temperature in this manner, the sequence proceeds to the aforementioned step S18 to effect transportation, cutting and discharge of the recording sheet 11. The energizing time of the thermal head 13 in steps S12 may be made shorter than that in the image recording in the step S5. The above-mentioned interruption in communication may result from the depression of a stop key in the transmitting equipment or from a deterioration in the state of a communication line.

In the present embodiment, as explained in the foregoing, when the recording operation is interrupted by an interruption in the communication, the separation of the ink sheet 14 and the recording sheet 11 is facilitated by energizing the thermal head 13 to maintain a high temperature state in the ink layer and advancing the recording sheet 11 in this state. In this manner the ink sheet can be kept from being damaged by sticking to the recording sheet 11.

OTHER EMBODIMENTS (FIG. 6)

In the foregoing embodiment, the energization of the thermal head 13 and the transportation of the recording sheet 11 are conducted in response to interruption of communication, but this separating process may also be conducted, in general, when the interval between recording of a line and that of a next line exceeds a predetermined time.

Figure 6:
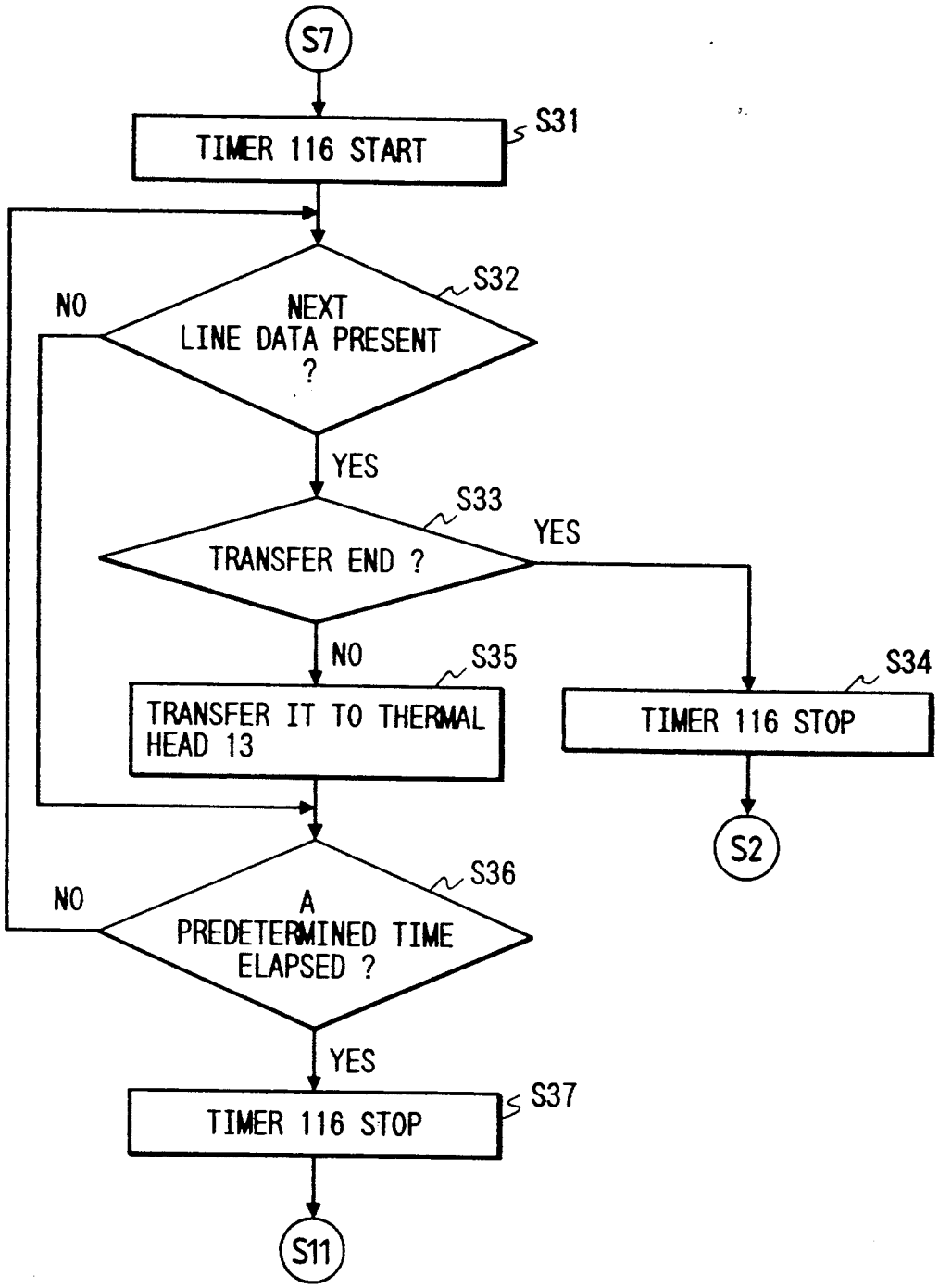
FIG. 6 is a flow chart of the recording sequence in another embodiment.

Such a sequence is shown in a flow chart in FIG. 6 and is executed when the discrimination of the step S7 in FIG. 5 turns out negative. At first step S31 starts the timer 116, and step S32 discriminates whether data of a next line to be recorded are present. In the absence of such data, the sequence proceeds to step S36. If the data of the next line are present, step S33 discriminates whether all the data of the next line have been transferred to the thermal head 13. If the data transfer has been completed, step S34 stops the timer 116, and the sequence proceeds to the step S2.

If the step S33 identifies that the transfer of data of the next line is not yet complete, the sequence proceeds to step S35 for transferring the data of the next line to the thermal head 13. Then step S36 discriminates, based on the time measurement by the timer 116, whether a predetermined time has elapsed after the recording of the present line, and, if the said predetermined time has elapsed, step S37 stops the timer 116 and the sequence proceeds to the step S11 in FIG. 5 for effecting the heat generation of the thermal head 13. In the flow chart shown in FIG. 5, the recording sheet 11 is cut and discharged in this heat generation process, but, if continued printing is desired on the same page, it is also possible to simply heat the ink sheet 14 and to return sequence to the step S31 thereby awaiting the data for the next line and transferring the data to the thermal head 13.

RECORDING PRINCIPLE (FIG. 7)

Figure 7:
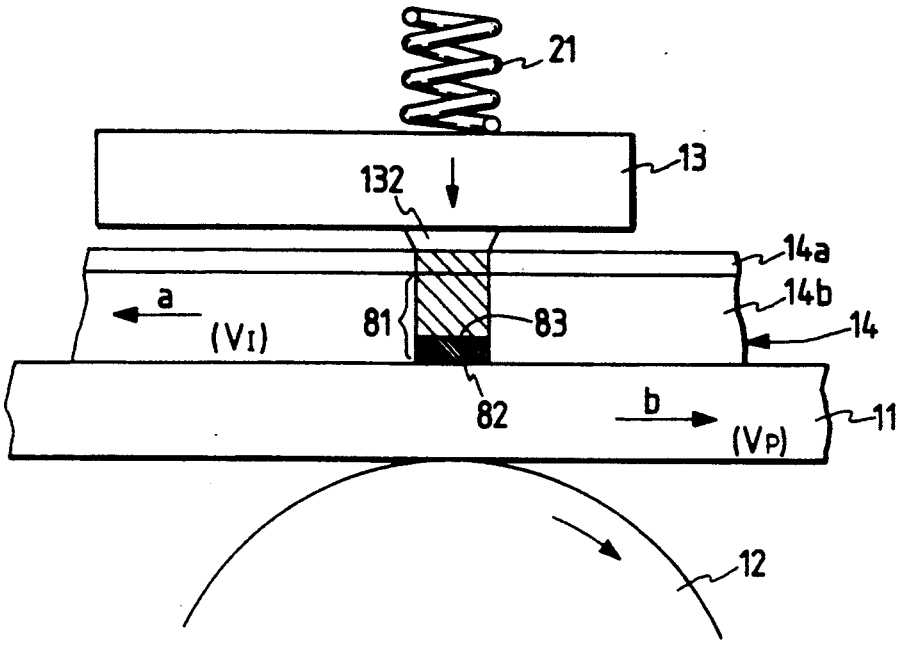
FIG. 7 is a cross-sectional view showing the state of the recording sheet and the ink sheet in a multi printing operation of the embodiment.

FIG. 7 illustrates the state of image recording, employing a multipoint ink sheet in the thermal transfer printer of the present embodiment, with mutually opposite transporting directions for the recording sheet 11 and the ink sheet 14.

The recording sheet 11 and the ink sheet 14 are pinched between the platen roller 12 and the thermal head 13, which is pressed against the platen roller 12 under a predetermined pressure exerted by the spring 21. The recording sheet 11 is transported in a direction b with a speed $V_P$, by the rotation of the platen roller 12, while the ink sheet 14 is transported in a direction a with a speed $V_I$ by the rotation of the ink sheet transport motor 25.

When the heat generating resistors 132 of the thermal head 13 are energized by the power source 105, a hatched portion 81 of the ink sheet 14 is heated. The ink sheet 14 is composed of a substrate film 14*a*, and an ink layer 14*b*. The ink of thus heated ink layer 81 is fused, and a part 82 thereof is transferred onto the recording sheet 11. The transferred ink layer portion 82 corresponds approximately to a formation 1/n of the ink layer 81.

INK SHEET (FIG. 8)

Figure 8:
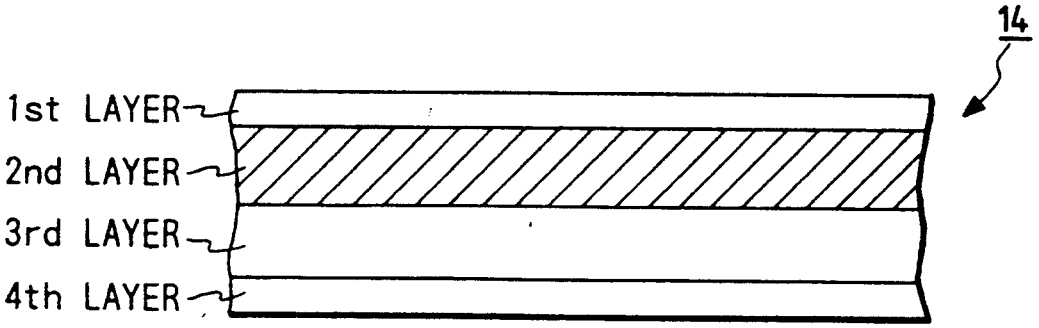
FIG. 8 is a cross-sectional view of the multi ink sheet employed in the embodiment.

FIG. 8 is a cross-sectional view of the ink sheet employed in the multi printing process of the present embodiment and composed of four layers in this case.

A substrate film of the ink sheet 14 constitutes a second layer. In the case of multi printing, since each part of the ink sheet is repeatedly subjected to the application of thermal energy, the substrate is advantageously composed of an aromatic polyamide film or a condenser paper with a high thermal resistance, but a conventional polyester film may also be used for this purpose. The thickness is preferably as small as possible for improving the print quality, but is desirably in a range of 6–8 microns in consideration of the strength.

A third layer is an ink layer containing ink in an amount sufficient to allow n transfers (n is at least one) onto the recording sheet. The layer is principally composed of a resinous adhesive such, as EVA, a coloring material such as carbon black or nigrosine dye, and a binding material such as caranuba wax or paraffin wax, so mixed as to enable the transfers of n times in a given place. The coating amount of the ink layer is generally in a range of 4–8 g/m$^2$, but can be arbitrarily selected according to the desired sensitivity and density.

A fourth layer is a top coating for preventing the transfer of the third layer due to pressure applied to the recording sheet in a non-printed area, and is composed for example of transparent wax. Thus the transfer by pressure takes place only in the fourth layer, and the recording sheet can be protected from the background smudge. A first layer is a heat resistant coating for protecting the substrate film of the second layer from the heat of the thermal head 13. Such a top coating is preferable for the multiprinting ink sheet in which thermal energy of n lines may be applied to a same position (when black information continues), but the presence or absence of this top coating may be arbitrarily selected. Also such a top coating is effective for a substrate film of a relatively low thermal resistance, such as a polyester film.

The structure of the ink sheet 14 is not limited to the embodiment explained above, but may also be composed of a substrate layer and a porous ink holding layer containing ink therein and provided on a of the substrate layer, or of a heat resistant ink layer consisting of a porous network structure formed on a substrate film and impregnated with ink. Also the substrate film may be composed, for example, of polyamide, polyethylene, polyester, polyvinyl chloride, triacetyl cellulose, nylon or paper. Also the heat resistant top coating, which is not always necessary, may be composed, for example, of silicone resin, epoxy resin, fluorinated resin or nitrocellulose.

Also an ink sheet with heat-sublimable ink can be composed, for example, of a substrate film of polyethylene terephthalate, polyethylene naphthalate or aromatic polyamide, and a coloring material layer formed thereon and containing dyes and spacer particles formed from guanamine resin and fluorinated resin.

Also the heating in the thermal transfer printer is not limited to the thermal head method explained above, but may also be achieved for example by direct current supply or by laser beam irradiation.

Also the foregoing embodiments have been limited to the printers with a thermal line head, but the present invention is likewise applicable to thermal transfer printers of the so-called serial type.

Also the recording medium is not limited to recording paper but can be any material capable of accepting ink transfer, such as cloth, or plastic sheet. Furthermore the ink sheet is not limited to the rolled structure shown in the foregoing embodiments, but can be of the so-called ink sheet cassette structure, in which a casing incorporating ink sheets is detachably mounted in the main body of the apparatus.

Furthermore, though the foregoing embodiments have been limited to facsimile apparatus, the present invention is not limited to such embodiments and is likewise applicable to a word processor, a typewriter, a copying machine or the like.

Furthermore, the advancement of the ink sheet may be achieved by the winding operation of the take-up roller 18.

As explained in the foregoing embodiments, when the recording operation is interrupted or when the interval of the recording operations exceeds a predetermined time, the thermal head 13 is energized to heat the ink sheet 14 and the ink sheet 14 is separated from the recording sheet 11 in this state, whereby damage or breakage in the ink sheet 14, resulting from sticking thereof to the recording sheet 11, can be prevented.

What is claimed is:

1. A facsimile apparatus utilizing a thermal transfer recording apparatus for recording an image on a recording medium by transferring an ink thereto from an ink sheet, comprising:

communicating means for receiving and transmitting an image data;

ink sheet transport means for transporting the ink sheet with a speed relative to the recording medium;

recording medium transport means for transporting the recording medium;

recording means for recording the image on the recording medium by acting on the ink sheet transported by said ink sheet transport means in accordance with the image data received by said communicating means, said recording means having a plurality of heat generating elements, each of said heat generating elements being adapted to generate heat when an electrical signal corresponding to black data is applied thereto;

detecting means for detecting an interruption in the receiving of the image data by said communicating means while the received data of one page is recorded;

heating control means for controlling heating of the ink sheet, said heating control means responding to a detection of the interruption of the receiving by said detecting means to apply the electrical signal corresponding to black data to all said heat generating elements; and transport control means for controlling said recording medium transport means so as to transport and eject a piece of said recording medium on which image recording has been interrupted after heating of said ink sheet by said heating control means.

2. A facsimile apparatus according to claim 1, wherein said transport control means causes said recording medium transport means to transport the recording medium by a predetermined amount after heating of the ink sheet.

3. A facsimile apparatus according to claim 1, further comprising timing means for timing having an output, wherein said heating control means is adapted to drive the plurality of heat generating elements in accordance with the output of said timing means.

4. A facsimile apparatus according to claim 1, wherein said plurality of heat generating elements is provided over an entire width of a recording area of said recording medium.

5. A facsimile apparatus according to claim 1, wherein said ink sheet transport means transports the ink sheet in a first direction which is opposite to a second direction in which the recording medium is transported by the recording medium transport means.

6. A facsimile apparatus according to one of claims 1, 2, 3, 4 or 5, wherein the ink sheet is a multi-print ink sheet in which recording of plural images can be performed on a given portion of the ink sheet.

* * * * *

UNITED STATES PATENT AND TRADEMARK OFFICE

CERTIFICATE OF CORRECTION

PATENT NO. : 5,248,996

DATED : September 28, 1993

INVENTOR(S) : Takahiro Kato, et al.

It is certified that error appears in the above-identified patent and that said Letters Patent is hereby corrected as shown below:

Column 4

Line 11, "sheet 14 a" should read --sheet 14; a--.
Line 21, "converted" should read --isconverted--.
Line 68, "3" should read --43--.

Column 5

Line 50, "multipoint" should read --multiprint--.
Line 63, "312" should read --132--.

Column 6

Line 39, "steps" should read --step--.
Line 52, "sheet" should read --sheet 14--.

Column 7

Line 26, "multipoint" should read --multiprint--.
Line 46, "formation" should read --fraction--.
Line 66, "such," should read --such--.
Line 68, "caranuba" should read --carnauba--.
Line 65, after "The" insert --ink--.

UNITED STATES PATENT AND TRADEMARK OFFICE

CERTIFICATE OF CORRECTION

PATENT NO. : 5,248,996

DATED : September 28, 1993

INVENTOR(S) : Takahiro Kato, et al.

It is certified that error appears in the above-identified patent and that said Letters Patent is hereby corrected as shown below:

Column 8

Line 24, "a of" should read --a side of--.

Signed and Sealed this

Seventeenth Day of May, 1994

*Attest:*

Bruce Lehman

BRUCE LEHMAN

*Attesting Officer*

*Commissioner of Patents and Trademarks*